United States Patent [19]

O'Shea et al.

[11] Patent Number: 4,951,926

[45] Date of Patent: Aug. 28, 1990

[54] CHOKE FOR INTERNAL COMBUSTION ENGINE

[75] Inventors: Patrick O'Shea; John Devine, both of Tralee, Ireland

[73] Assignee: 501 Tillotson Limited, Tralee, Ireland

[21] Appl. No.: 358,837

[22] Filed: May 30, 1989

[30] Foreign Application Priority Data

May 31, 1988 [IE] Ireland ..... 1645/88

[51] Int. Cl.[5] ..... F02M 1/14

[52] U.S. Cl. ..... 261/64.4

[58] Field of Search ..... 261/64.4

[56] References Cited

U.S. PATENT DOCUMENTS

| | | | |
|---|---|---|---|
| 759,396 | 5/1904 | Rutenber | 261/64.4 |
| 1,073,179 | 9/1913 | Sprung | 261/64.4 |
| 1,273,356 | 7/1918 | Good | 261/64.4 |
| 1,285,609 | 11/1918 | Bubb | 261/64.4 |
| 1,369,250 | 2/1921 | Landis | 261/64.4 |
| 1,379,474 | 5/1921 | Osborne | 261/64.4 |
| 4,711,744 | 12/1987 | Scott et al. | 261/64.4 |

*Primary Examiner*—Tim Miles

*Attorney, Agent, or Firm*—Harness, Dickey & Pierce

[57] ABSTRACT

A choke for use with a carburetor on an internal combustion engine comprises a housing having an air inlet and an air outlet the air outlet being adapted for communication with the air intake of a carburetor. A valve means within the housing includes a valve member and means biassing the valve member in a direction to block the passage of air between the air inlet and the air outlet of the housing. The valve means is responsive to engine vacuum during starting of the engine to move the valve member in a direction against the biassing means to permit air to enter the carburetor from outside the housing via the air inlet and air outlet thereof.

3 Claims, 4 Drawing Sheets

CHOKE FOR INTERNAL COMBUSTION ENGINE

The present invention relates to chokes or starting aids for small internal combustion engines and more particularly to a choke or starting aid which is responsive to the vacuum developed during start up of an internal combustion engine.

When starting small internal combustion engines, it is usually necessary to pull on the starter rope several times before the engine kicks over and begins to run. Generally, after a couple of pulls on the starter rope the engine starts and runs for a short period of time and then stops. This is what is commonly known in the field as a "false start". This "false start" phenomenon has been present in the chainsaw art for several years and has come to be accepted by the users of such saws as an acceptable starting method. The user generally has knowledge of the fuel system procedure and understands why the system is not starting.

The difficulty in starting a cold internal combustion engine centres around the choke system of these particular engines. When the choke system is in a closed position, the fuel line system of the cold engine has a very high restriction in the air intake. The restriction of the air intake forms a vacuum in the fuel line, sucking fuel into the engine via the carburetor from the fuel tank. As the starting rope is pulled, the engine sucks fuel into the carburetor by the vacuum created in the system. As the engine begins to fire, a certain amount of air is necessary to keep the engine running. With a manual choke butterfly type, the user must open the choke quickly after the engine begins running or the user will experience the false start phenomenon. The reason for the "false start" is that as the speed of the engine increases, the engine sucks more fuel. With the choke in the closed position, however, the amount of air flow entering the engine is not increased. Thus a proper mixture of air and fuel is not achieved and the engine dies instantly. Also, if the engine does not start up a substantial amount of fuel is sucked into the engine, via the carburetor causing the engine to become flooded, further hampering the starting procedure of the engine.

If the user is not familiar with the start up procedure, misses the false start and keeps pulling the starter rope with the choke on, the engine becomes so flooded that the spark plug, crankcase and cylinder must be allowed to dry out before start up.

Accordingly, it is an object of the present invention to mitigate the above mentioned problems.

According to the present invention there is provided a choke for use with a carburetor on an internal combustion engine, the choke comprising a housing having an air inlet and an air outlet, the air outlet being adapted for communication with the air intake of a carburetor, and valve means within the housing including a valve member and means biassing the valve member in a direction to block the passage of air between the air inlet and the air outlet of the housing, the valve means being responsive to engine vacuum to move the valve member in a direction against the said biassing means to permit air to enter the carburetor from outside the said housing via the air inlet and air outlet thereof during starting of the engine.

An embodiment of the invention will now be described, by way of example, with reference to the accompanying drawings in which.

Figure 1:
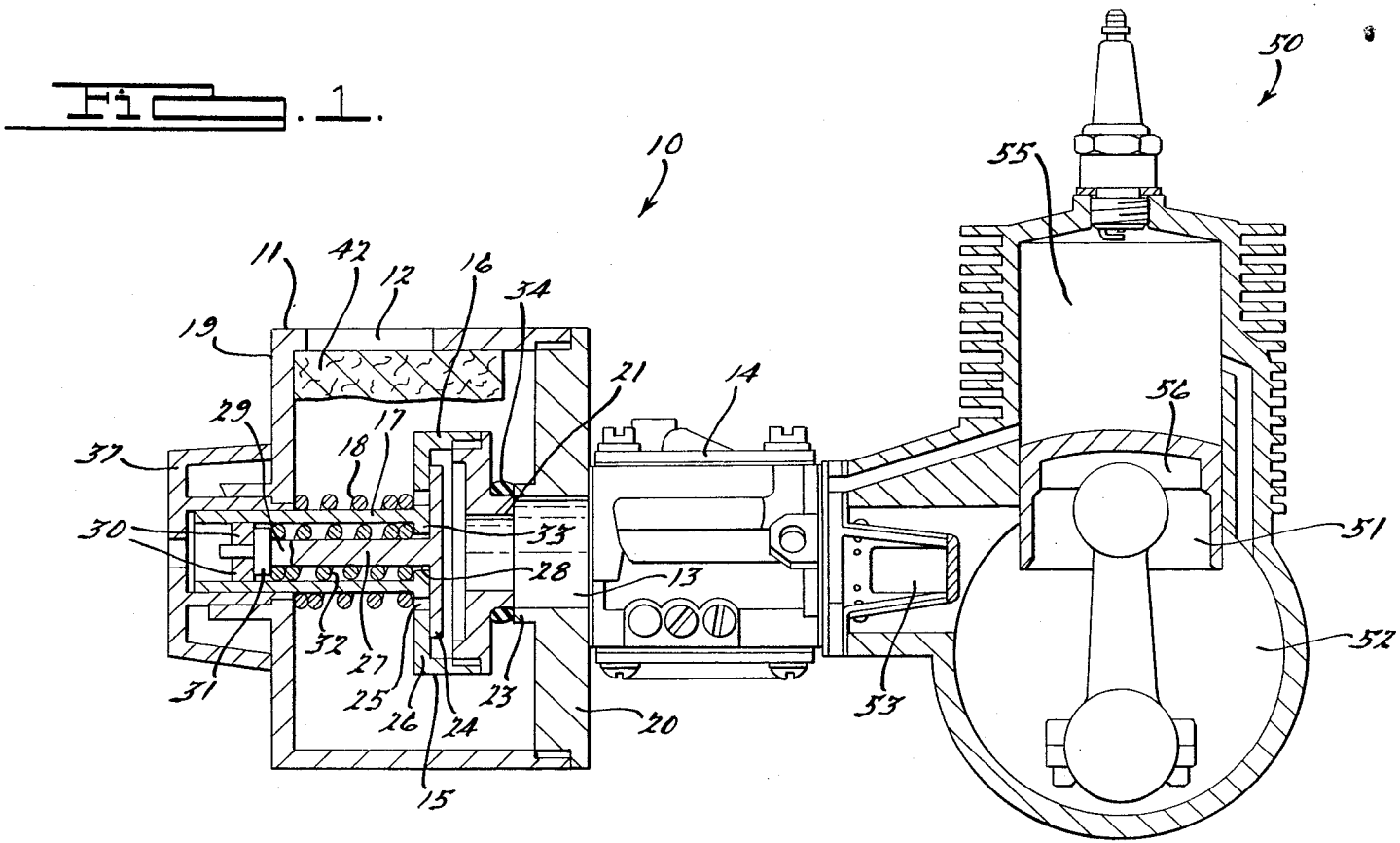
FIG. 1 is a cross-sectional view of a choke and combustion engine according to the invention, with the valve member in a closed condition.

Referring now to the drawings wherein similar numerals have been used to indicate like parts, there is shown therein a choke for use on a carburetor generally indicated at 10 according to the invention. The choke 10 comprises a housing 11 having an air inlet 12 and an air outlet 13.

The housing 11 is secured to a carburetor 14 so that the air outlet 13 is in communication with the air inlet (not shown) of the carburetor 14. The housing contains a valve means 15 disposed between the air inlet 12 and the air outlet 13. The valve means 15 comprises a shallow cylindrical valve chamber 16 integrally formed with a hollow shaft 17. A coil spring 18 acts in compression between the internal sidewall 19 of the housing 11 and the chamber 16 to bias the chamber 16 against the opposite internal sidewall 20 of the housing 11. A portion 21 of the chamber 16 is of reduced diameter and forms an air outlet for the chamber 16 which projects slightly into the air outlet 13 of the housing 11. An 'O' ring seal 34 is secured around the portion 21 of the chamber 16 so that it abuts the adjacent region 23 of the sidewall 20 to provide a substantially airtight seal.

A flat valve member 24 is located within the valve chamber 16 and is arranged to open and close apertures 25 in a flat valve seat region 26 of the valve chamber 16, the apertures 25 constituting an air inlet for the chamber 16. The valve member 24 is integrally formed with a shaft 27 which projects within the hollow shaft 17 through an aperture 28 in the chamber 16. The end 29 of the shaft 27 is threaded and carries a nut 30 and washer 31. A coil spring 32 is located on the shaft 27 and acts in compression between the nut and washer and the portion 33 of the valve chamber 16 within the region of the hollow shaft 17, so as to urge the valve member 24 against the valve seat region 26. The end 35 of the hollow shaft 17 projects out of the housing 11 through an aperture 36 in the sidewall 19 and is secured to a control knob 37.

Figure 3:
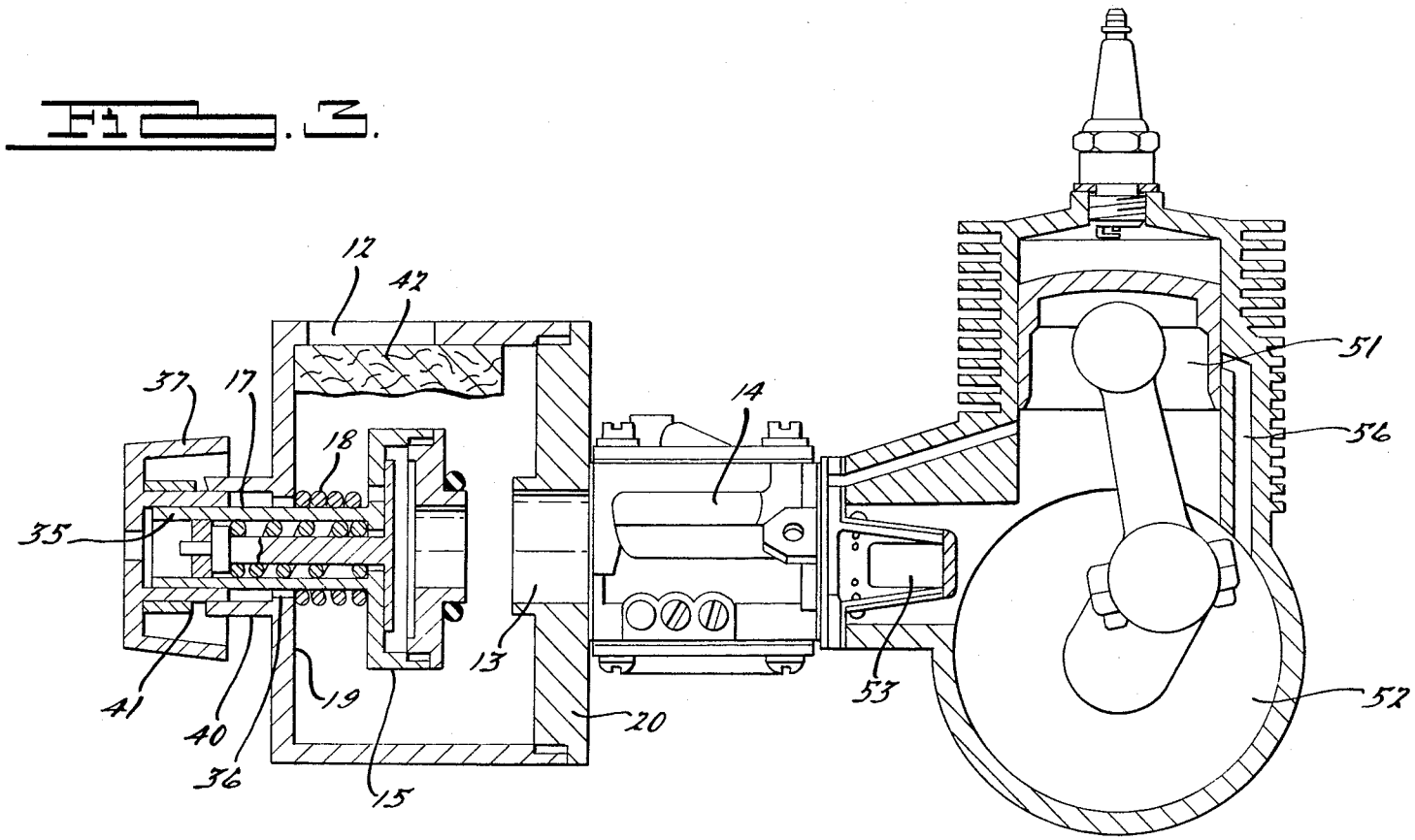
FIG. 3 is a cross-sectional view of the choke and engine but with the valve means moved to a position in which the air outlet is continuously open.
Figure 4:
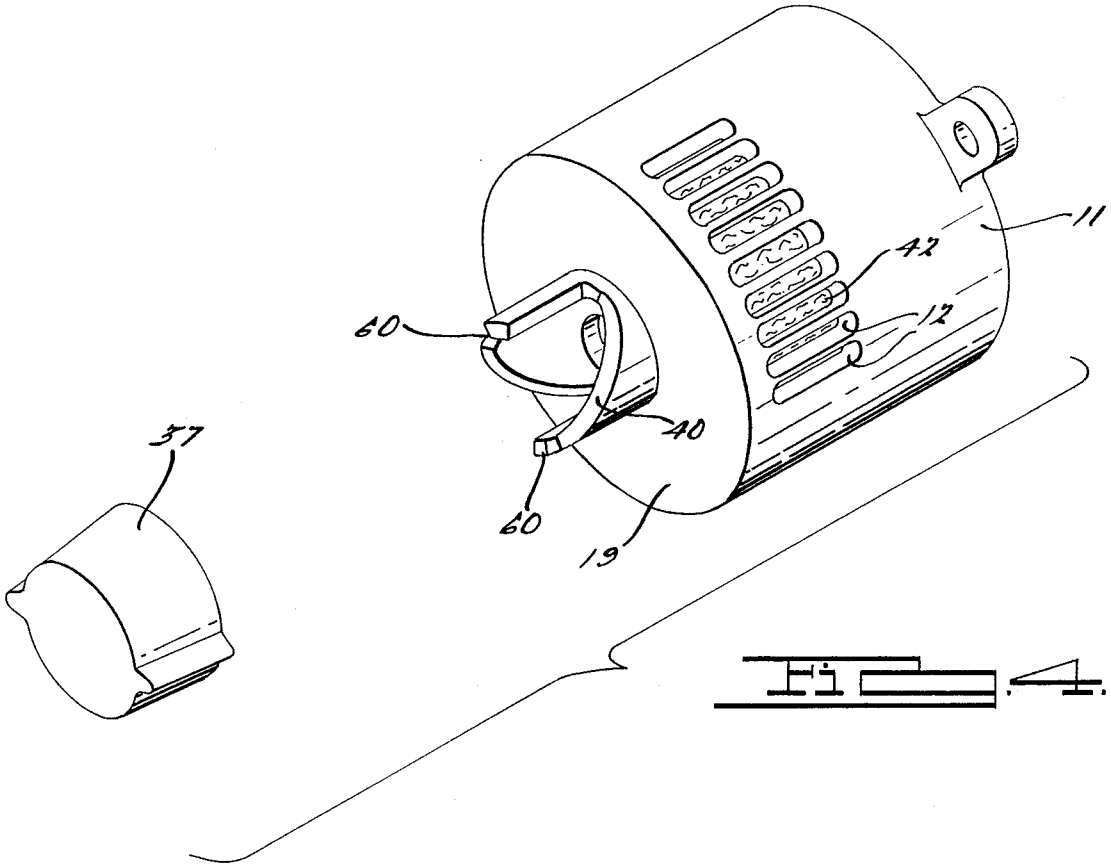
FIG. 4 is a perspective view of the housing and control knob.

The sidewall 19 of the housing 11 has an outwardly projecting cam surface 40 and the control knob 37 has a cam follower surface 41, so that rotation of the knob through approximately 90° causes the hollow shaft 17 and thus the valve means 15 to be moved to the left as shown in FIG. 3, thus exposing the air outlet 13. The cam surface 40 has formed thereon suitable recesses 60 to enable the knob 37 to be retained in its rotated position with the hollow shaft 17 in the leftmost position. Clearly, as the knob is rotated and valve means 15 is moved to the left, the coil spring 18 is compressed, and when the knob is rotated in the opposite direction, the coil spring 18 acts to urge the valve means 15 into abutment with the sidewall 20 again. The housing 11 also has an air filter 42 secured adjacent to the air inlet 12 to filter air entering the housing 11.

As shown, the carburetor 14 is attached to an internal combustion engine 50. As the piston 51 of the engine 50 reciprocates up and down, it causes corresponding periodic vacuum signals in the engine crankcase 52 which are transmitted to the air outlet 13 via a reed valve 53. The combustion mixture enters the engine crankcase 52 and it is transferred to the cylinder 55 via conduit 56 as the piston moves downwards to bottom dead centre.

Figure 2:
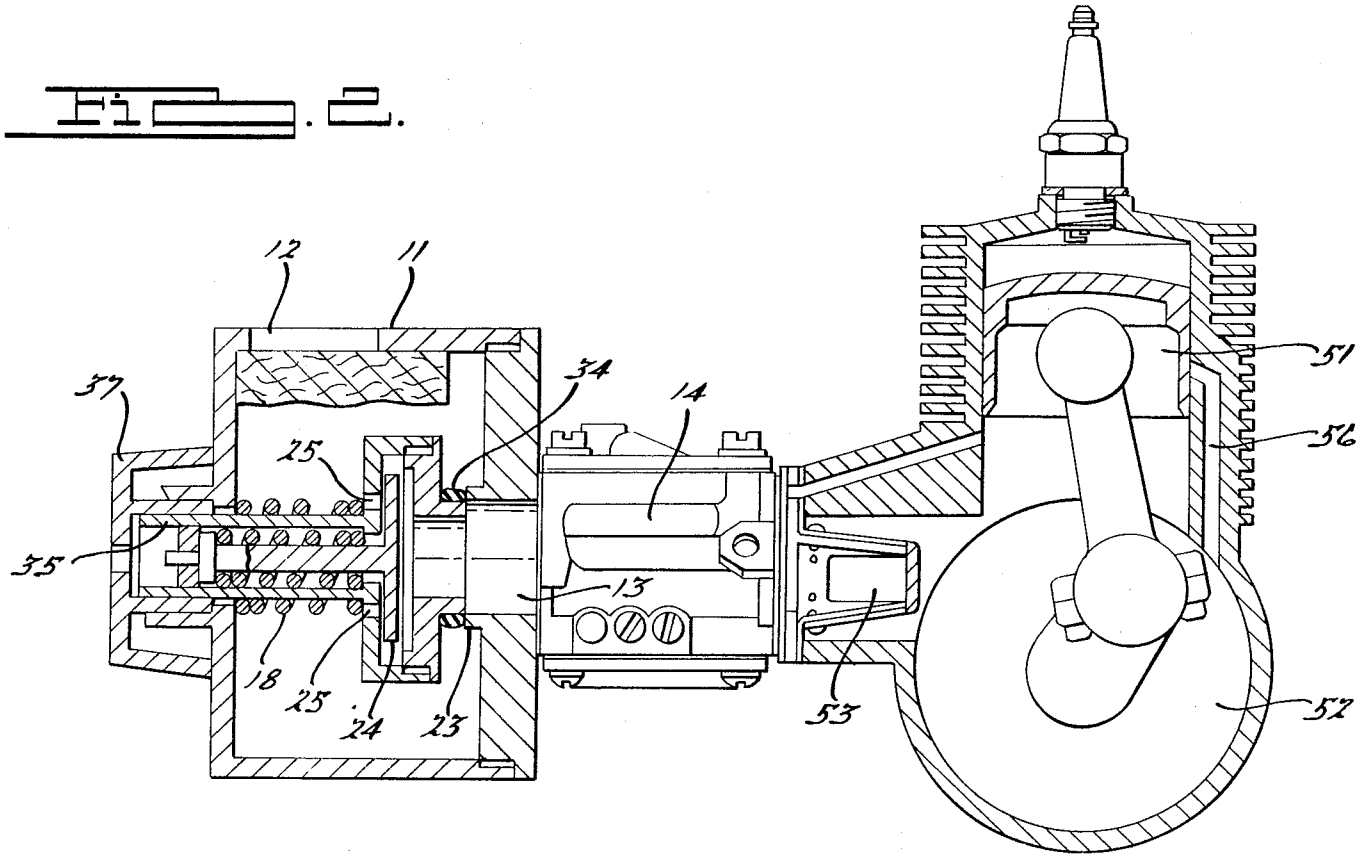
FIG. 2 is a cross-sectional view of the choke and engine similar to that of FIG. 1 but with the valve member open.

Thus, as the piston 51 approaches top dead centre, the vacuum signal produced in the crankcase opens the reed valve 53, thus transmitting the vacuum signal to the air inlet 13. The vacuum signal then acts to draw the valve member 24 off the valve seat 26 against the bias of the coil spring 32, thus allowing air to enter the carburetor 14 via the air inlet 12, apertures 25 and air outlet 13. Thus, sufficient air is allowed to enter the carburetor to allow a start and run condition of the engine. The position of the valve member 24 in the starting mode of the engine is illustrated in FIG. 2. The user does not therefore have to open the choke quickly after the engine starts, thus mitigating the problem of the prior art.

In FIG. 1, the piston 51 is at bottom dead centre and there exists a high pressure pulse signal in the crankcase 52 which acts to close reed valve 53 resulting in a decrease in the vacuum signal in the carburetor 14, enabling the valve member 24 to return to its initial position on the valve seat 26, thus closing the apertures 25.

As shown in FIG. 3, once the engine has been started, the control knob 37 is rotated to move the valve means 15 bodily away from the outlet aperture 13, against the bias of the spring 18 to enable continuous running of the engine. It will be appreciated that the size of the air outlet 13, the area of the valve member 24, and the strength of the coil spring 32 will determine the number of pulls to start the engine, the speed at which the engine runs with the choke on and the time period for which the engine will run with the choke on.

The parameters are selected such that:

(A) The engine will start and run in the same number of pulls or an acceptable one or two extra pulls as the conventional butterfly choke and will remain running with the choke on, or run for a sufficient period of time that would enable the operator to knock the choke "off" manually.

(B) If in the starting mode the ignition switch was switched "off", choke "on", engine cranked ten times, the engine must start in no more than a further 5/7 pulls with the choke in the "off" position, and the ignition switch in the "on" position. If the same occurred with the butterfly choke, the engine would be so flooded that the spark plug, crankcase and cylinder must be allowed to dry out before start up.

TEST RESULTS

Tests were carried out on the Stihl FS-60 strimmer.

TEST NO. 1

Vacuum Test

The vacuum developed at the fuel inlet during cranking was recorded with the conventional butterfly choke and the disc choke. The disc choke designs parameters were selected to fulfill the afore mentioned criteria.

Butterfly Choke 5 pulls—5" $H_2O$

Disc Choke 5 pulls—5" $H_2O$

TEST NO. 2

Start Test

The number of pulls required to start and run a completely dry cold engine with both types of choking systems was recorded.

BUTTERFLY CHOKE 6 pulls for a false start with the choke "on" and one extra pull for a start and run with the choke "off".

DISC CHOKE 7 pulls for a start and run with the choke "on", and remains running at 4500/5000 rpm with the choke on.

NOTE: In previous two tests the engine settings were:

IDLE—2400/2500 rpm

W.O.T.—7300/7500 rpm

Also, when starting an engine with the choke according to the invention, the throttle must be held in the fully open position, instead of the partially open position with the butterfly choke. Although the invention has been described for use on a reed valve engine it will also clearly have application on other engines for example, piston ported engines.

We claim:

1. A choke for use with a carburetor of an internal combustion engine, the choke comprising a housing having an air inlet and an air outlet, the air outlet being adapted for communication with the air intake of a carburetor, and a valve means within the housing; the valve means comprising a valve member, a valve chamber, a first biasing means and a second biasing means; the valve chamber having an outlet port in communication with the air outlet of the housing and at least one aperture in communication with the interior of the housing; the valve member being contained within the valve chamber and being biased by the first biasing means in a direction to close the said at least one aperture; the valve chamber being biased by the second biasing means in a direction to block the passage of air between the air inlet and the air outlet of the housing; the valve means being responsive to engine vacuum to move the valve member in a direction against the first biasing means to permit air to enter the carburetor form outside the housing via the air inlet, at least said one aperture, the outlet port and the air outlet during starting of the engine; means for overriding the operation of the valve means to maintain a continuously open path between the air inlet and the air outlet during normal running of the engine, said overriding means including means for moving the valve chamber in a direction away from the air outlet against the second biasing means.

2. A choke according to claim 1, wherein the valve chamber has a shaft projecting out of the housing and the second biassing means comprises a spring surrounding the shaft and in compression between the housing and the valve chamber, and wherein the overriding means comprises means cooperating with the shaft externally of the housing for manually moving the shaft against the force of the spring.

3. A choke according to claim 2, wherein the said shaft is hollow, and the valve member has a second shaft extending out of the valve chamber within the first shaft and wherein the first biassing means comprises a further spring surrounding the second shaft within the first shaft and in compression between the valve chamber and an abutment fixed to the second shaft.

* * * * *